United States Patent [19]

Rüenzi

[11] 4,032,135

[45] June 28, 1977

[54] APPARATUS FOR INDIVIDUALLY REMOVING SHEETS FROM A STACK

[76] Inventor: Kurt Rüenzi, Kusnachterstrasse 59, 8126 Zumikon, Switzerland

[22] Filed: Apr. 8, 1976

[21] Appl. No.: 674,918

[30] Foreign Application Priority Data

Apr. 15, 1975 Switzerland ..... 4758/75

[52] U.S. Cl. ..... 271/116; 271/124; 271/127

[51] Int. Cl.[2] ..... B65H 3/06

[58] Field of Search ..... 271/121, 122, 124, 125, 271/127, 110, 111, 116

[56] References Cited

UNITED STATES PATENTS

| | | | |
|---|---|---|---|
| 390,277 | 10/1888 | Allen | 271/127 X |
| 650,410 | 5/1900 | Morin | 271/121 |
| 3,838,851 | 10/1974 | Kolibas | 271/124 |
| 3,900,192 | 8/1975 | Gibson | 271/110 X |

*Primary Examiner*—Richard A. Schacher
*Attorney, Agent, or Firm*—W. G. Fasse; W. W. Roberts

[57] ABSTRACT

This apparatus removes individual sheets of paper or the like from a stack regardless of the thickness of each sheet. A sheet stack support is journaled in a housing in see-saw fashion. A first set of sheet separating rollers is arranged above the downstream end of the support as viewed in the direction of sheet movement. A spring urges the downstream end of the support upwardly and thus sheets on the support against the first set of rollers. A stop for the sheets is located adjacent to said downstream end of the support. A table is located substantially adjacent said downstream end and below a second set of sheet separating rollers. The table has a cut-out and a sheet separating gate slants through the cut-out below the second set of rollers. The gate is spring biased toward the second set of rollers. Further sets of rollers may be arranged downstream of the second set of rollers. These rollers are driven in such a manner that each downstream set runs faster than the next adjacent upstream set of rollers. The rollers, especially of the first and second set, are preferably of the free wheeling type, whereby a passing sheet may drive the rollers faster than the power drive for the respective rollers.

14 Claims, 5 Drawing Figures

APPARATUS FOR INDIVIDUALLY REMOVING SHEETS FROM A STACK

BACKGROUND OF THE INVENTION

The invention relates to an apparatus for individually removing sheets from a stack of sheets, for example, paper or the like, including a sheet stack support member and several power driven sheet separating roller sets.

Sheet separating devices for paper sheets or the like are well known. These devices supply the sheets to office machines, such as printers, duplicators, copiers or to other types of processing. Prior art devices are constructed in such a manner that they must be adjusted precisely to the particular type of paper thickness employed for any particular type of operation. If it is necessary to change to another paper thickness a careful new adjustment must be made. The required adjustments make the conventional paper feeders or sheet separators expensive and subject to trouble which may occur, because the adjustment has changed during the operation. Further, the adjustments are time consuming.

OBJECTS OF THE INVENTION

In view of the above, it is the aim of the invention to achieve the following objects singly or in combination:

to separate sheets of paper from a stack individually and independently of the thickness of the paper sheets;

to provide an apparatus capable of separating paper sheets from a stack, whereby the individual sheets of paper may have different thicknesses even in the same stack; and to construct the sheet separating apparatus in such a manner that it will be avoided to transport more than one sheet at a time regardless of the thickness of the individual sheets.

SUMMARY OF THE INVENTION:

According to the invention there is provided an apparatus for individually removing or separating sheets from a stack, wherein the sheet stack support is constructed as a see-saw and wherein a plurality of rollers cooperate with the see-saw and with further elements for the sheet removal and advance from the stack. One sheet at a time will pass through the apparatus to avoid clogging. A spring urges the see-saw type of support and thus the sheets of paper on the support against a first set of rollers rotatably supported in the housing of the apparatus. These rollers are motor driven. A table or surface is arranged substantially adjacent to the downstream end of the support and a further set of motor driven rollers is arranged above the table. A stop surface or member is arranged downstream and adjacent to the sheet stack support. The table and the first set of rollers are arranged in such a manner relative to each other that the line of contact between the first set of rollers and the top sheet of the stack is located substantially in the same plane as that defined by the table. A separating gate is arranged below the table but reaches through a cut-out in the table at an angle relative to the table. The separating gate is located below the second set of separating rollers. The top surface of the separating gate is provided with friction increasing cover means to retard a second sheet that might have been advanced below and along with the top sheet from a stack. The above combination of features according to the invention has the advantage that no adjustment of the various elements relative to each other is necessary while simultaneously sheets of paper having different thicknesses may be processed. Even in one and the same stack the sheets may have individually differing thicknesses.

BRIEF FIGURE DESCRIPTION

In order that the invention may be clearly understood, it will now be described, by way of example, with reference to the accompanying drawings, wherein.

DETAILED DESCRIPTION OF EXAMPLE EMBODIMENTS

Figure 1:
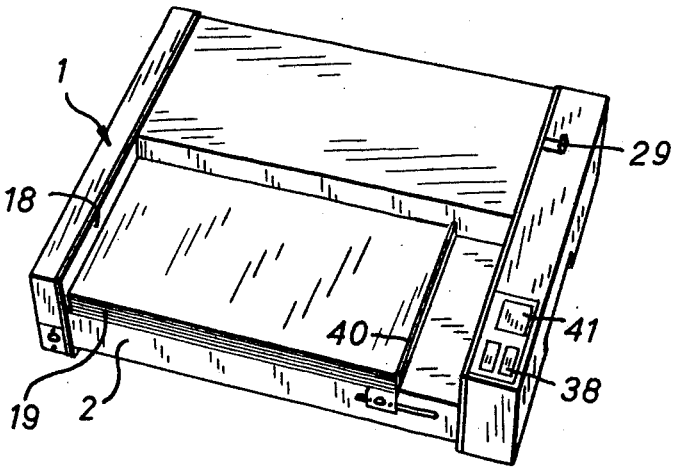
FIG. 1 is a perspective overall view of the present apparatus.

The sheet separating apparatus of the present invention includes a housing 1 made of sheet metal or plastics material. A sheet stack support 2 is journaled in the housing in the manner of a see-saw. The support carries a stack 19 of paper sheets to be individually removed from the stack for further processing. The journal axis 3 of the see-saw type of support 2 is secured to the side walls 18 of the housing 1 for the tilting movement. The journal axis 3 extends horizontally through the housing. The support 2 is urged in the direction of the arrow A upwardly by means of a relatively weak spring 4. The stack 19 of sheets of paper or the like is manually placed on top of the support 2 in such a manner that the forward edge of the stack rests snuggly against a substantially vertically extending stop member 20. An upwardly extending wall member 40 is laterally adjustable back and forth to fix the position of the stack 19 in the lateral direction.

Figure 2:
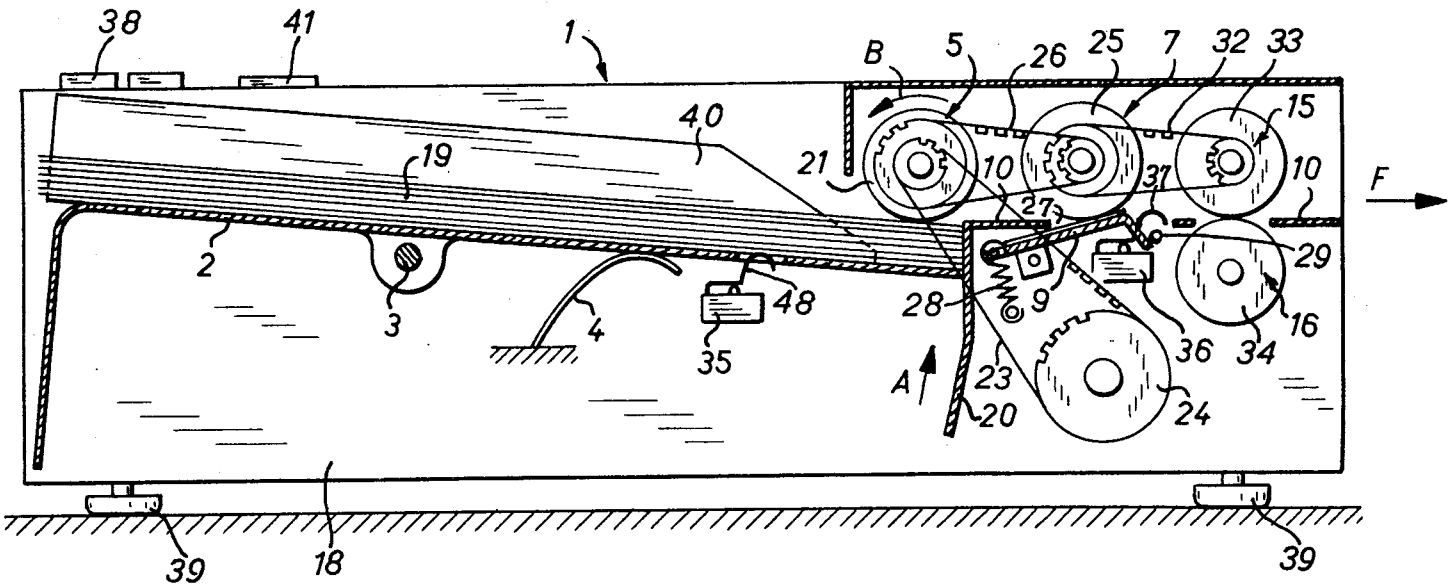
FIG. 2 is a vertical section through the present apparatus.

Referring to FIG. 2, a first sheet separating set of rollers 5 is supported for rotation in the housing 1 above the downstream end of the stack 19 and close to the stop member 20. The set 5 of sheet separating rollers comprises a plurality of rollers 21 axially spaced along and rigidly secured to a horizontal shaft 6, which in turn is rotatably supported in the side walls of the housing. A drive motor 24 drives the shaft 6 in the direction of the arrow B by means of a power transmission element such as a gear belt 23. The top sheet on the stack comes into contact with the lower surface of the rollers 21 because the spring 4 urges the support 2 and thus the stack 19 lightly in the upward direction and hence against the rollers 21. The line of contact between the top sheet and the rollers 21 is located substantially or practically at the same level as a substantially horizontally extending table surface 10 of metal, plastics, or the like. The sheets travel individually over the table surface 10 in the direction of the arrow F after removal of a sheet from the stack.

Figure 3:
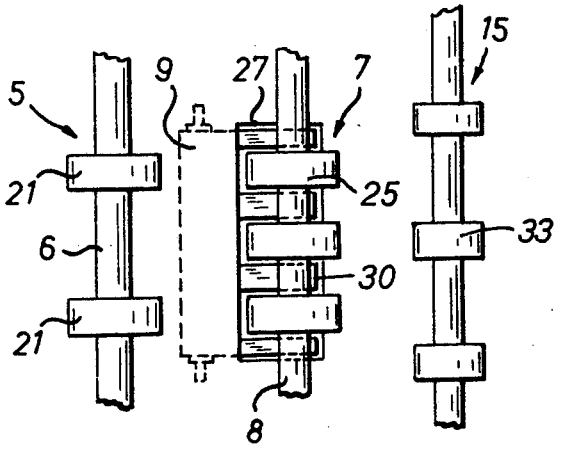
FIG. 3 illustrates a top view onto the sheet separating sets of rollers also showing the sheet separating gate in dashed lines below the table over which the sheets advance.

Above the table surface 10 and substantially at the same level as the first sheet separating roller set 5, there is arranged a second sheet separating roller set 7, which comprises several rollers 25 rigidly secured to a shaft 8 driven by a transmission member, such as a gear belt 26. The rollers 25 have the same diameter as the rollers 21. The diameters of the drive gears for the roller sets 5 and 7 are selected in such a manner that an upward translation is accomplished. In other words, the rollers 25 rotate faster than the rollers 21, or rather the circumferential speed of the rollers 25 is larger than that of the rollers 21. The rollers 25 of the second set 7 are located above a cut-out 27 in the table surface 10 as best seen in FIGS. 2 and 3. A separating gate 9 extends through the cut-out 27 at an angle relative to the table surface 10. Preferably, the angle is within the range of 8° to 15°.

The separating gate 9 is supported in the housing also in see-saw fashion by a journal axis. A spring 28 urges the separating gate 9 in a counter-clockwise direction and thus with a slight pressure toward the rollers 25, however, without contacting these rollers directly. A bent over portion of the separating gate 9 extends substantially downwardly and rests against an adjustable stop member 29, whereby the spacing between the separating gate 9 and the rollers 25 may be varied within a limited range. The stop member 29 is adjustable from outside the housing of the apparatus and may comprise a cam member extending more or less toward the bent down portion of the separating gate 9 depending on the position of the stop member 29.

Figure 4:
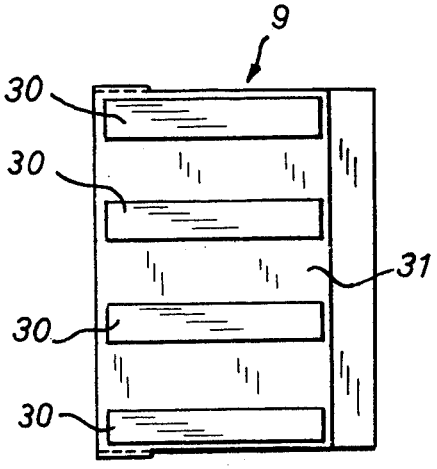
FIG. 4 is a top view onto the sheet separating gate.
Figure 5:
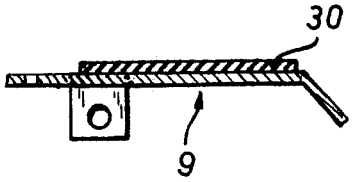
FIG. 5 is a sectional view through the sheet separating gate according to FIG. 4.

As shown in FIGS. 4 and 5, the separating gate 9 is provided at its top surface with friction increasing means. Preferably, these friction increasing means are rubber strips 30 extending in the transport direction F. These rubber strips 30 increase the friction relative to a sheet of paper moving over the separating gate 9. The strips 30 are preferably made of soft rubber having a higher coefficient of friction relative to paper than steel. Thus, the individual sheets encounter a larger frictional resistance relative to the rubber strips 30 and thus against a movement in the transport direction F than on the table 10, whereby only the upper sheet will be transported and any sheet that might have left the stack below the top sheet will be retarded, so that only the top sheet will be transported in the direction of the arrow F. The rubber strips 30 extend upwardly somewhat above the level defined by the lower side of the rollers 25, whereby each individual sheet takes on a somewhat corrugated shape as it passes below the rollers 25 since the strips 30 are also spaced in such a manner that the rollers 25 are located above these spaces between the strips 30.

Downstream of the second separating roller set 7 and horizontally spaced therefrom there are arranged two more roller sets 15 and 16 located vertically one above the other, or somewhat displaced relative to each other in the feed advance direction. The further roller sets 15 and 16 form a contact plane with the sheet to be transported or they form a narrow gap therebetween substantially in the plane of the top surface of the table 10. For this purpose a further cut-out is provided in the table 10 as seen in FIG. 2, and the lower set of rollers 16 reaches through said further cut-out in the table 10. The drive for the roller set 15 is derived from the drive of the roller set 7 by means of a transmission member, such as a gear belt 32. A upward transmission or translation is provided between these two rollers so that the roller set 15 is driven faster than the roller set 7. Preferably, one of the two roller sets 15 or 16 is vertically adjustable or spring supported. In those instances, where the individual sheets are immediately taken up as they emerge from the gap between the gate 9 and the rollers 25, for example by a further processing apparatus, it may not be necessary to employ the roller sets 15 and 16 at all.

The rollers 21, 25 and 33 are provided around their circumference with a soft rubber or a soft synthetic material layer having a relatively high friction coefficient relative to paper. Each of the rollers 21 and 25 are preferably also the rollers 33 and 34 are provided with a free wheeling take over mechanism. Such mechanisms are well known in the art, for example, in connection with free wheeling bicycle drives. These free wheeling rollers are capable of rotating faster than the speed determined by the drives through the gear belts 23, 26 and 32. This situation may occur when an individual sheet is taken up by the rollers 25 which have a larger circumferential speed than the rollers 21. The same situation would occur when the sheet is taken up between the rollers 33 and 34, since the set of rollers 15 is driven faster than the set of rollers 7. The increasing of the rotational speeds in the transport direction has the advantage that individual sheets are prevented from getting stuck.

The apparatus according to the invention operates as follows. A stack 19 of paper sheets, which may have varying thicknesses up to the thickness of semi-cardboard, is manually placed on the support 2 so that the topmost sheet rests against the rollers 21 of the first set 5 of sheet separating rollers. The spring 4 presses the support 2 with a small force against these rollers 21 of the first set 5. The motor 24 is now started by pressing a button 38 shown in FIG. 1, whereby the first topmost sheet is transported in the direction F. Normally only the topmost sheet will be transported. However, if one or more additional sheets should be taken along, for example, when these sheets stick to each other, no problem will result, because of the arrangement of the cooperating parts relative to each other as taught herein, whereby it is prevented that more than one sheet is supplied, for example, to a copier or to a printing press. The cooperation between the separating gate 9 and the second set of separating rollers 25 prevents a second sheet from travelling along with the top sheet in the direction of the arrow F. This is accomplished because only the top sheet is held against the rollers 25, whereas any sheet below the top sheet is retarded by the rubber strips 30 on the surface of the separating gate 9, because these rubber strips 30 have a relatively large friction coefficient relative to paper.

Due to the somewhat slanted position of the separating gate 9 relative to the table surface 10, a sheet advancing on the table is forced into a narrowing gap, whereby only the top sheet will be further transported. As soon as the top sheet is contacted by the second separating roller set 7, the speed of the sheet is increased in the direction of the arrow F, whereby the rollers 21 reach the same speed as the rollers 25 of the second set, because both rollers 21 and 25 roll along the same sheet. This is possible due to the free wheeling of these rollers similarly to the free wheeling or coasting of a bicycle. Thus, the rollers 21 may run faster than they are driven by the motor 24. As soon as a sheet has passed the rollers 21 of the set 5, the latter takes up the speed by which it is driven through the motor 24. This has the advantage that a spacing is established between successive sheets, which is important if, for example, the further handling of the sheets is controlled through photocells, which respond to such spacings between successive sheets.

As soon as a sheet, which is driven by the rollers 25 of the second set, comes into the gap between the rollers 33 and 34, these rollers further transport the sheet. The rollers 33 and 34 are driven faster than the rollers 25 of the second set 7. This further increases the spacing between two successive sheets. However, as mentioned, it might not be necessary to arrange the roller sets 15 and 16 as part of the present apparatus. Such rollers may form the input gap of a next successive machine or of an intermediate conveyor device.

The electrical control may be such that merely individual sheets are separated from the stack one at a time as needed, or the arrangement may be such that the sheet separation takes place in a continuous repeatedly successive operation. If the separation takes place only once in a while, the motor 24 may be started by pressing a respective button 38 or the motor may receive a starting impulse from an apparatus arranged downstream of the present sheet separating device. The motor is stopped by interrupting the energizing circuit for the motor 24 through a micro-switch 36, which responds to the trailing edge of a sheet passing over a sensing member 37 of a micro-switch 36, whereby the sensing member 37 reaches through the cut-out 27 in the table 10. Thus, the micro-switch 36 is actuated substantially as soon as the sheet leaves the gap between the rollers 25 and the gate 9. On the other hand, where a continuous operation is desired, it is the purpose of the micro-switch 36 to actuate a counter 41 which will switch off the motor 24 upon reaching a preadjusted number of sheets. These arrangements are as such well known in the art. Furthermore a micro-switch 35 having a sensing lever 48 reaching through an aperture in the support 2 whereby the switch 35 will stop the motor 24 when the last sheet of a stack 19 has been taken off the support 2. Incidentally, the entire apparatus is constructed as a portable unit and provided with feet 39 to place it on a table or the like.

Although the invention has been described with reference to specific example embodiments, it is to be understood, that it is intended to cover all modifications and equivalents within the scope of the appended claims.

What is claimed is:

1. An apparatus for removing individual sheets from a stack regardless of sheet thickness, comprising a housing, sheet stack support means having a downstream end, journal means supporting said sheet stack support means in said housing in see-saw fashion, and sheet separating roller means comprising a first set of sheet separating rollers including a first shaft rotatably supported in said housing, said first set of rollers being drivably secured to said first shaft, said first shaft supporting said first set of rollers above said downstream end of said sheet stack support means, spring means in said housing arranged to urge the downstream end of said sheet stack support means toward said first set of rollers, power drive means for rotating said first set of rollers at a given speed, table means having a surface arranged substantially adjacent to said downstream end of said sheet stack support means, a second set of sheet separating rollers arranged in said housing above said table surface, stop means for a stack on said sheet stack support means, said stop means being located adjacent to said downstream end of said sheet stack support means, said first set of rollers being located so that their lowest sheet contacting surface line extends in a plane substantially corresponding to that of said table surface, at least one cut-out in said table means, a separating gate journalled in said housing a resiliently biassed to extend through said cut-out at an oblique angle relative to said table means, said separating gate being located below said second set of sheet separating rollers with its highest point above said table surface, and friction increasing cover means on said separating gate, said friction increasing cover means facing said second set of sheet separating rollers, said first set of sheet separating rollers comprising free wheeling overtake rollers, said apparatus further comprising means for driving the second set of sheet separating rollers faster than the first set of sheet separating rollers when said first set of sheet separating rollers are driven at said given speed.

2. The apparatus of claim 1, wherein said rollers have circumferential surfaces with high friction coefficient relative to paper.

3. The apparatus according to claim 1, wherein said friction increasing cover means on said separating gate comprise friction strips secured to said separating gate, said friction strips having spaces therebetween and wherein the rollers of said second set of sheet separating rollers are also spaced from each other so as to fit into said spaces between adjacent friction strips.

4. The apparatus according to claim 1, wherein said plurality of sheet separating roller means comprise a third set of sheet separating rollers arranged downstream of said second set of sheet separating rollers, said apparatus further comprising means for driving said third set of rollers faster than said second set of rollers.

5. The apparatus according to claim 1, wherein said angle of said sheet separating gate relative to said table surface is within the range of about 8° to about 15°.

6. The apparatus according to claim 1, further comprising an aperture in said sheet separating gate, micro-switch means located below said sheet separating gate and sensing means arranged to actuate said micro-switch means in response to sensing through said gate means a sheet passing over said gate means.

7. The apparatus according to claim 1, further comprising sensing means arranged downstream of said second set of sheet separating rollers to sense the presence of a separated sheet below the second set of rollers.

8. The apparatus according to claim 7, wherein said sensing means comprise a micro-switch.

9. The apparatus according to claim 1, further comprising sensing means for ascertaining the presence of a sheet stack on said sheet stack support means.

10. The apparatus according to claim 9, wherein said sensing means comprise a micro-switch having a sensing lever, said sheet stack support means having a hole therethrough, said sensing lever extending through said hole to register the presence of a sheet or stack on said support means.

11. The apparatus according to claim 1, wherein said table means and said stop means form an integral structure.

12. The apparatus according to claim 11, wherein said integral structure is a piece of sheet metal having a substantially vertical section forming said stop means and a substantially horizontal section forming said table means.

13. The apparatus of claim 1, comprising means for driving said second set of rollers from said first set of rollers, including toothed belt means.

14. In an apparatus for removing individual sheets from a stack, including a first set of axially aligned, and spaced apart driven rollers, a pivotally mounted stack support, means resiliently urging the leading edge of an upper sheet of said stack support against said first set of rollers, a stop engaging the lower sheets on said stack support, and a second set of axially aligned and spaced apart driven rollers positioned downstream of said first set in the transport direction of sheets on said stack; the improvement comprising a table surface positioned between said first and second sets of rollers at substantially the same level as the bottoms of the rollers of said first and second sets, whereby said rollers of said first two sets separate at least one sheet on said stack and feed it along said table surface toward said second set of rollers, a cut-out in said table surface below said second set of rollers, a gate pivotally mounted at said cut-out, means resiliently urging said gate upwardly through said cut-out toward said second set of rollers, friction increasing strip means on the top of said gate and axially separated from said rollers of said second set, and stop means inhibiting contact between said rollers of said second set and said gate, whereby said second set of said rollers and said friction increasing strip means inhibit the passage of more than one sheet to said apparatus independently of the thickness of said sheets.

* * * * *